US006841206B2

(12) United States Patent
Quintens et al.

(10) Patent No.: US 6,841,206 B2
(45) Date of Patent: Jan. 11, 2005

(54) INK JET RECORDING ELEMENT

(75) Inventors: Dirk Quintens, Westerlo (BE); Hubertus Van Aert, Pulderbos (NL)

(73) Assignee: Agfa-Gevaert, Mortsel (BE)

( * ) Notice: Subject to any disclaimer, the term of this patent is extended or adjusted under 35 U.S.C. 154(b) by 125 days.

(21) Appl. No.: 10/054,210

(22) Filed: Nov. 12, 2001

(65) Prior Publication Data

US 2002/0094421 A1 Jul. 18, 2002

Related U.S. Application Data

(60) Provisional application No. 60/256,532, filed on Dec. 18, 2000.

(30) Foreign Application Priority Data

Nov. 30, 2000 (EP) ..... 00204256

(51) Int. Cl.[7] ..... B41M 5/40
(52) U.S. Cl. ..... 428/32.34
(58) Field of Search ..... 428/32.34, 32.25, 428/32.28, 32.3, 32.38

(56) References Cited

U.S. PATENT DOCUMENTS

| | | | | |
|---|---|---|---|---|
| 4,395,499 A | | 7/1983 | Rosenski et al. | 523/206 |
| 4,657,821 A | | 4/1987 | Ura et al. | 428/510 |
| 4,904,519 A | * | 2/1990 | Newman | 428/203 |
| 5,741,584 A | * | 4/1998 | Imabeppu et al. | 428/32.24 |
| 6,153,288 A | | 11/2000 | Shih et al. | 428/195 |
| 6,187,430 B1 | * | 2/2001 | Mukoyoshi et al. | 428/331 |
| 6,455,136 B1 | * | 9/2002 | Okajima et al. | 428/32.1 |
| 6,495,243 B1 | * | 12/2002 | Malhotra | 428/32.24 |
| 6,511,736 B1 | * | 1/2003 | Asano et al. | 428/206 |
| 6,592,953 B1 | * | 7/2003 | Ceruti et al. | 428/32.24 |

FOREIGN PATENT DOCUMENTS

| | | |
|---|---|---|
| EP | 0 140 227 | 5/1985 |
| EP | 0 365 307 | 4/1990 |
| WO | 92/01836 | 2/1992 |

OTHER PUBLICATIONS

European Search Report, Application No. EP 00 20 4256 (Aug. 3, 2001).

* cited by examiner

*Primary Examiner*—B. Shewareged
(74) *Attorney, Agent, or Firm*—Joseph T. Guy; Nexsen Pruet, LLC

(57) ABSTRACT

An improved medium for ink jet recording is disclosed. Apart from a pigment and an optional binder, the ink receiving layer contains a film-forming latex being a polymer containing repeating units derived from a particular monomer type. Preferred monomers are vinyl ester monomers most preferably derived from versatic acid.

The medium is particularly suited for outdoor use.

5 Claims, No Drawings

INK JET RECORDING ELEMENT

This application claims the benefit of U.S. Provisional Application No. 60/256,532 filed Dec. 18, 2000.

FIELD OF THE INVENTION

The present invention relates to an improved recording element for ink jet printing.

BACKGROUND OF THE INVENTION

In the majority of applications printing proceeds by pressure contact of an ink-loaden printing form with an ink-receiving material which is usually plain paper. The most frequently used impact printing technique is known as lithographic printing based on the selective acceptance of oleophilic ink on a suitable receptor.

In recent times however so-called non-impact printing systems have replaced classical pressure-contact printing to some extent for specific applications. A survey is given e.g. in the book "Principles of Non Impact Printing" by Jerome L. Johnson (1986), Palatino Press, Irvine, Calif. 92715, USA.

Among non-impact printing techniques ink jet printing has become a popular technique because of its simplicity, convenience and low cost. Especially in those instances where a limited edition of the printed matter is needed ink jet printing has become a technology of choice. A recent survey on progress and trends in ink jet printing technology is given by Hue P. Le in *Journal of Imaging Science and Technology* Vol. 42 (1), January/February 1998.

In ink jet printing tiny drops of ink fluid are projected directly onto an ink receptor surface without physical contact between the printing device and the receptor. The printing device stores the printing data electronically and controls a mechanism for ejecting the drops image-wise. Printing is accomplished by moving the print head across the paper or vice versa. Early patents on ink jet printers include U.S. Pat. No. 3,739,393, U.S. Pat. No. 3,805,273 and U.S. Pat. No. 3,891,121.

The jetting of the ink droplets can be performed in several different ways. In a first type of process a continuous droplet stream is created by applying a pressure wave pattern. This process is known as continuous ink jet printing. In a first embodiment the droplet stream is divided into droplets that are electrostatically charged, deflected and recollected, and into droplets that remain uncharged, continue their way undeflected, and form the image. Alternatively, the charged deflected stream forms the image and the uncharged undeflected jet is recollected. In this variant of continuous ink jet printing several jets are deflected to a different degree and thus record the image (multideflection system).

According to a second process the ink droplets can be created "on demand" ("DOD" or "drop on demand" method) whereby the printing device ejects the droplets only when they are used in imaging on a receiver thereby avoiding the complexity of drop charging, deflection hardware, and ink recollection. In drop-on-demand the ink droplet can be formed by means of a pressure wave created by a mechanical motion of a piezoelectric transducer (so-called "piezo method"), or by means of discrete thermal pushes (so-called "bubble jet" method, or "thermal jet" method).

Ink compositions for ink jet typically include following ingredients: dyes or pigments, water and/or organic solvents, humectants such as glycols, detergents, thickeners, polymeric binders, preservatives, etc. It will be readily understood that the optimal composition of such an ink is dependent on the ink jetting method used and on the nature of the substrate to be printed. The ink compositions can be roughly divided in:

- water based; the drying mechanism involves absorption, penetration and evaporation;
- oil based; the drying involves absorption and penetration;
- solvent based; the drying mechanism involves primarely evaporation;
- hot melt or phase change: the ink vehicle is liquid at the ejection temperature but solid at room temperature; drying is replaced by solidification;
- UV-curable; drying is replaced by polymerization.

It is known that the ink-receiving layers in ink-jet recording elements must meet different stringent requirements:

- The ink-receiving layer should have a high ink absorbing capacity, so that the dots will not flow out and will not be expanded more than is necessary to obtain a high optical density.
- The ink-receiving layer should have a high ink absorbing speed (short ink drying time) so that the ink droplets will not feather if smeared immediately after applying.
- The ink dots that are applied to the ink-receiving layer should be substantially round in shape and smooth at their peripheries. The dot diameter must be constant and accurately controlled.
- The receiving layer must be readily wetted so that there is no "puddling", i.e. coalescence of adjacent ink dots, and an earlier absorbed ink drop should not show any "bleeding", i.e. overlap with neighbouring or later placed dots.
- Transparent ink-jet recording elements must have a low haze-value and be excellent in transmittance properties.
- After being printed the image must have a good resistance regarding water-fastness, light-fastness, and good endurance under severe conditions of temperature and humidity.
- The ink jet recording element may not show any curl or sticky behaviour if stacked before or after being printed.
- The ink jet recording element must be able to move smoothly through different types of printers.

All these properties are often in a relation of trade-off. It is difficult to satisfy them all at the same time.

It is known that the presence in the ink accepting layer of absorptive pigments such as silica, kaolin, talc, aluminum oxide, boehmite, etc. improve the absorption capacity, the obtainable colour density and the drying time. Many patent applications have described this effect for many different binder-systems. U.S. Pat. No. 3,357,846 describes pigments such as kaolin, talc, bariet, $TiO_2$ used in starch and PVA. U.S. Pat. No. 3,889,270 describes silica in gelatin, PVA and cellulose. Pigments and particles have also been described in patent applications including DE 2,925,769, GB 2,050,866, U.S. Pat. No. 4,474,850, U.S. Pat. No. 4,547,405, U.S. Pat. No. 4,578,285, WO 88 06532, U.S. Pat. No. 4,849,286, EP 339604, EP 400681, EP 407881, EP 411638 and U.S. Pat. No. 5,045,864 (non-exhaustive list).

These particulates are dispersed in various types of binders of which the most common types such as gelatin, polyvinyl alcohol, polyvinyl pyrrolidone, and various types of cellulose derivatives. These conventional binders are mentioned in numerous patent documents.

It is further known to use various types of film-forming polymers to improve the waterfastness of the coated ink receiving layer by increasing its adhesion to the support.

It is also known to improve the waterfastness of the finished printed image by the incorporation of mordanting polymers bearing cationic quaternary groups such as ammonium-, sulphonium and phosphonium groups. These polymers interact with most typical ink jet inks resulting in a better anchoring of the dye in the binder. Typical examples of such descriptions are U.S. Pat. No. 4,371,582, U.S. Pat. No. 4,575,465, U.S. Pat. No. 4,649,064, GB 2 210 071 and EP 423829.

Since the present invention is particularly directed to an improved recording material for outdoor use, such as billboards, banners, signs and advertisement pannels, it will be readily understood that the so-called weatherability characteristics of such a material are of prior importance. These necessary characteristics include excellent water-fastness, light-fastness, and resistance to high and low temperature.

It is well known to those skilled in the art that the use of inks containing pigments gives superior ink jet images when light-fastness is concerned. So printing with pigment inks is preferred when the final image is meant for outdoor use. However, such images suffer from a lack of water-fastness, since the pigments remain partially near the surface of the medium and can be partially smeared out in wet condition by a certain mechanical force, e.g. a wet finger stroke. So, there is a permanent need for improvement for water-fastness for this type of materials.

The present invention extends the teachings on ink jet recording materials and is particularly directed to to an improved material for outdoor use.

OBJECTS OF THE INVENTION

It is an object of the present invention to provide an ink jet recording element with improved water-fastness.

It is a further object of the invention to provide an ink jet recording element which is particularly suited for outdoor use.

SUMMARY OF THE INVENTION

The above mentioned objects are realised by providing an ink jet recording element comprising a support and a receiving layer comprising a pigment, an optional binder and a film-forming polymer latex, characterized in that said polymer latex is a homopolymer or copolymer containing repeating units derived from the following monomer (formula I):

(I)

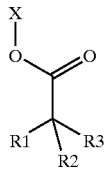

wherein,

X represents an unsaturated polymerisable unit,

R1 and R2 each independently represent hydrogen, alkyl or aryl,

R3 represents alkyl or aryl.

In a first preferred embodiment said monomer according to formula (I) is a vinyl ester monomer according to formula II below:

(II)

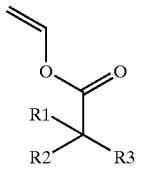

In a second preferred embodiment said monomer according to formula (I) is an acrylic monomer represented by formula (III) below:

(III)

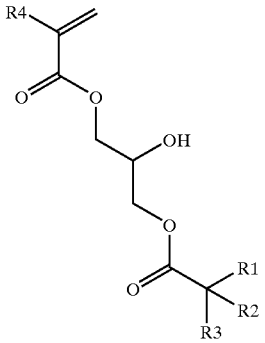

wherein,

R4 represents hydrogen or methyl.

In the first preferred embodiment wherein the monomer is a vinyl ester monomer (formula II) it is most preferably a vinyl versatate.

DETAILED DESCRIPTION OF THE INVENTION

The present invention will now be further explained on the hand of its preferred embodiments.

It is the essence of the present invention that the ink receiving layer, apart from the pigment and the optional binder, contains a film-forming (co)polymeric latex comprising repeating units derived from the monomer class of formula (I) defined above.

Particularly suited monomers according to formula (II) for incorporation in the (co)polymer are so-called vinyl versatic acid ester monomers (or vinyl versatates). Versatic acids are highly branched $C_9$–$C_{11}$ aliphatic carboxylic esters (Römpps Chemie-Lexikon, 7$^e$ edition, p. 3803).

Commercially available vinyl versatates which are particularly suited are following compounds:

VeoVA 9 (trade mark of Shell Chemicals Co.): neo-nonanonic acid, ethenyl ester; CAS No. 54423-67-5; in formula (I) R3 is $CH_3$; R1 and R2 taken together are $C_6H_{14}$;

VeoVa 10 (trade mark of Shell Chemicals Co.): tert-decanoic acid, ethenyl ester; other names: tert-decanoic acid, vinyl ester; versatic 10 acid, ethenyl ester; CAS No. 26544-09-2; in formula (I) R3 is $CH_3$; R1 and R2 taken together are $C_7H_{16}$;

VeoVa 11 (trade mark of Shell Chemicals Co.): tert-undecanoic acid, ethenyl ester; CAS No. 163633-66-7; in formula (I) R3 is $CH_3$; R1 and R2 taken together are $C_8H_{18}$.

A commercially available monomer according to formula (III) is Craynor 152 (trade mark of Cray Valley): reaction product of tert-decanoic acid, oxiranylmethyl ester (available as Cardura E10, tradename of Shell Chemical= glycidyl ester of versatic 10 acid, CAS No. 71206-09-2) with acrylic acid. Craynor 152 can be prepared as shown in the scheme below:

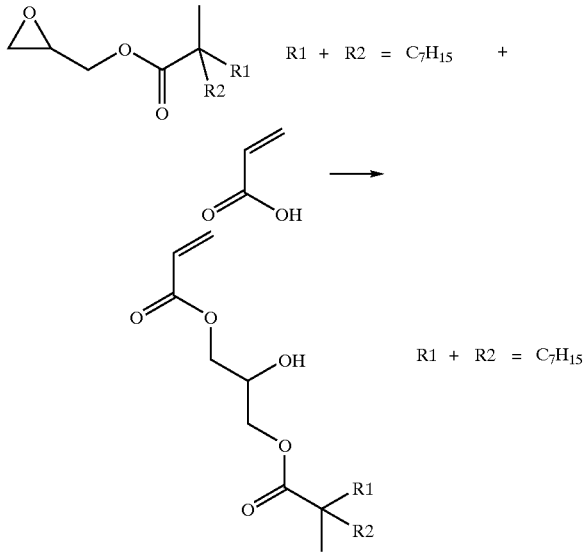

Other suitable monomers (according to formula II) for incorporation in the (co)polymer, although less preferred are:

VeoVa 5 (registered trade mark of Shell Chemicals Co.): CAS No. 3377-92-2; in formula (I) R1=R2=R3=$CH_3$;

vinyl propanoate; CAS No. 105-38-4; in formula (I) R1=H, R2=H, R3=$CH_3$;

vinyl 2-ethylhexoate; CAS No. 94-04-2; in formula (I) R1=H, R2=$C_2H_5$, R3=n-$C_4H_9$;

2-ethylhexyl-2-propenoate; CAS No. 103-11-7; in formula (I) R1=H, R2=H, R3=tert-$C_7H_{15}$.

The film-forming latex can be a homopolymer completely built up from the monomer of formula (I) as described. More preferably, it can be a copolymer incorporating repeating units derived from other monomers beside the monomer of formula (I). In a particularly preferred embodiment the copolymer contains structural units derived from ethylene and/or vinyl acetate monomers, beside the vinyl ester monomers. The ratio of the different monomers must be chosen so that the resulting polymer latex is film-forming under normal conditions of coating, drying and storage of the ink receiving layer.

Useful commercially available copolymers include following compounds:

POLYSOL EVA P550, trade mark of Showa High Polymer Co., an ethylene-vinyl acetate-vinyl versatate copolymer, stabilized with a non-ionic polymer;

MOWILITH LDM1355, trade mark of Clariant Co., an ethylene-vinyl acetate-vinyl versatate copolymer, stabilized with an anionic surfactant;

MOWILITH DM 22, 21, 2110, trade marks of Clariant Co.; these are vinyl acetate-vinyl versatate copolymers MOWILITH DM 2452, trade mark of Clariant Co.; this is a vinylacetate-vinyl versatate-acrylic ester copolymer.

ENOREX 50 AVV, trade mark of Collano Ebnother AG; this is a vinylacetate-vinyl versatate-acrylic ester copolymer, stabilized with polyvinylalcohol.

ENOREX 50 CVM, registered trade mark of Collano Ebnother AG; this is a vinylacetate-vinyl versatate-maleic ester copolymer, stabilized with a cellulose derivative.

ENOREX WS 45 D, registered trade mark of Collano Ebnother AG; this is a vinylacetate-vinyl versatate copolymer, stabilized with a polyvinyl alcohol.

CLAVIFIX, registered trade mark of Collano Ebnother AG; this is a vinylacetate-vinyl versatate copolymer, stabilized with a polyvinyl alcohol.

ENOREX 55CV, registered trade mark of Collano Ebnother AG; this is a vinylacetate-vinyl versatate copolymer, stabilized with a cellulose derivative.

A copolymer dispersion of 43 wt % VeoVa 11 and 57 wt % vinylacetate, stabilized with a cellulose derivative (Cellosize QP300), an anionic surfactant (Rhodacal DS10) and an non-ionic surfactant (Disponil O 250) (indicated in the examples as experimental dispersion).

Beside the polymer latex containing monomer units of formula (I) according to the present invention the receiving layer contains a pigment and optionally a binder.

The pigment present in the ink receiving layer may be chosen from organic material such as polystyrene, polymethylmethacrylate, silicones, urea-formaldehyde condensation polymers, polyesters and polyamides. Preferably however, it is an inorganic porous pigment, such as silica, talc, clay, koalin, diatomaceous earth, calcium carbonate, magnesium carbonate, aluminium hydroxide, aluminium oxide, titanium oxide, zinc oxide, barium sulfate, calcium sulfate, zinc sulfide, satin white, boehmite and pseudo-boehmite.

The preferred pigment is a silica type, more particularly an amorphous silica having a average particle size ranging from 1 $\mu$m to 15 $\mu$m, most preferably from 2 to 10 $\mu$m. The use of non-colloidal silica types in ink jet receiver formulations is known for long time, e.g. from old references such as JP-A 55-051583, JP-A 56-000157, U.S. Pat. No. 4,474,850 and DE 3410828. The silica is preferably present in the receiving layer in an amount ranging from 5 g/$m^2$ to 30 g/$m^2$. A finer silica type or a colloidal silica type may also be present.

When a binder is present it can be chosen from a list of compounds well-known in the art including hydroxyethyl cellulose; hydroxypropyl cellulose; hydroxyethylmethyl cellulose; hydroxypropyl methyl cellulose; hydroxybutylmethyl cellulose; methyl cellulose; sodium carboxymethyl cellulose; sodium carboxymethylhydroxethyl cellulose; water soluble ethylhydroxyethyl cellulose; cellulose sulfate; polyvinyl alcohol; vinylalcohol copolymers; polyvinyl acetate; polyvinylacetal; polyvinyl pyrrolidone; polyacrylamide; acrylamide/acrylic acid copolymer; styrene/acrylic acid copolymer; ethylene-vinylacetate copolymer; vinylmethyl ether/maleic acid copolymer; poly(2-acrylamido-2-methyl propane sulfonic acid); poly(diethylene triamine-co-adipic acid); polyvinyl pyridine; polyvinyl imidazole; polyimidazoline quaternized; polyethylene imine epichlorohydrin modified; polyethylene imine ethoxylated; poly(N, N-dimethyl-3,5-dimethylene piperidinium chloride; polyethylene oxide; polyurethane; melamine resins; gelatin; carrageenan; dextran; gum arabic; casein; pectin; albumin; starch; collagen derivatives; collodion and agar-agar.

A preferred binder for the practice of the present invention is polyvinyl alcohol (PVA). This PVA can be partially silanol modifided as it is the case with the Poval R polymer series, trade name of Kuraray Co., Japan.

When a binder or binder mixture is present in the receiving layer its weight ratio is preferably lower than 50 weight % vis-à-vis the total coating weight of the layer.

The total dry coating weight of the receiving layer is preferably comprised between 10 and 40 g/m$^2$.

Apart from the essential ingredients described above a cationic substance acting as mordant may be present in the ink receiving layer. Such substances increase the capacity of the layer for fixing and holding the dye of the ink droplets. A particularly suited compound is a poly (diallyldimethylammonium chloride) or, in short, a poly (dadmac). These compounds are commercially available from several companies, e.g. Aldrich, Nalco, Clariant, BASF, EKA Chemicals, and Nippon Goshei. A preferred type is GOHSEFIMER K210, trade name of Nippon Goshei Co.

Other useful cationic compounds include dadmac copolymers such as copolymers with acrylamide; dimethylamine-epichlorohydrine copolymers, e.g. POLYFIX 700, trade name of Showa High Polymer Co.; other POLYFIX grades which could be used are POLYFIX 601, POLYFIX 301, POLYFIX 301A, POLYFIX 250WS, and POLYFIX 3000; NEOFIX E-117, trade name of Nicca Chemical Co., a polyoxyalkylene polyamine dicyanodiamine, and REDIFLOC 4150, trade name of EKA Chemicals, a polyamine; MADAME (methacrylatedimethylaminoethyl=dimethylaminoethyl methacrylate) or MADQUAT (methacryloxyethyltrimethylammonium chloride) modified polymers, e.g. ROHAGIT KL280, ROHAGIT 210, ROHAGIT SL144, PLEX 4739L, PLEX 3073 from Röhm, DIAFLOC KP155 and other DIAFLOC products from Diafloc Co., and BMB 1305 and other BMB products from EKA chemicals; cationic epichlorohydrin adducts such as POLYCUP 171 and POLYCUP 172, trade names from Hercules Co.; from Cytec industries: CYPRO products, e.g. CYPRO 514/515/516, SUPERFLOC 507/521/567; cationic cellulose derivatives such as CELQUAT L-2OO, H-1OO, SC-240C, SC-230M, trade names of Starch & Chemical Co., and QUATRISOFT LM200, UCARE polymers JR125, JR400, LR400, JR30M, LR30M and UCARE polymer LK; fixing agents from Chukyo Europe: PALSET JK-512, PALSET JK512L, PALSET JK-182, PALSET JK-220, WSC-173, WSC-173L, PALSET JK-320, PALSET JK-320L and PALSET JK-350; polyethyleneimine and copolymers, e.g. LUPASOL, trade name of BASF AG; triethanolamine-titanium-chelate, e.g. TYZOR, trade name of Du Pont Co.; copolymers of vinylpyrrolidone such as VIVIPRINT 111, VIVIPRINT 121, VIVIPRINT 131 trade names of ISP, a methacrylamido propyl dimethylamine copolymer; with dimethylaminoethylmethacrylate such as COPOLYMER 845 and COPOLYMER 937, trade names of ISP; with vinylimidazole, e.g. LUVIQUAT CARE, LUVITEC 73W, LUVITEC VPI55 K18P, LUVITEC VP155 K72W, LUVIQUAT FC905, LUVIQUAT FC550, LUVIQUAT HM522, and SOKALAN HP56, all trade names of BASF AG; polyamidoamines, e.g. RETAMINOL and NADAVIN, trade marks of Bayer AG; and phosphonium compounds such as disclosed in EP 609930.

Still other cationic compounds include gelatin when the layer pH is below the isoelectric point of the gelatin, cationic aluminum oxide, boehmite, and poly (aluminumhydroxychloride) such as SYLOJET A200, trade name of Grace Co. Still further cationic polymers include polyvinylamines, e.g. PVAM-0595B from Esprit Co., and cationic modified acrylics, e.g. ACRIT RKW319SX, trade name of Tasei Chemical Industries, and RD134 from Goo Chemical.

In an alternative embodiment the cationic substance is not incorporated in the ink receiving layer itself but in a separate thin top layer. In this case this layer is coated from an aqueous medium. Its dry coverage is preferably comprised between 0.5 and 5 g/m$^2$. The cationic mordant can also be distributed between the ink receiving bulk layer and the extra thin top layer.

Depending on the surface properties of the substrate an extra adhesive layer may be applied between the support and the ink receiving layer (undercoat layer). This layer is then coated from an aqueous medium containing any of the numerous known adhesive polymers. Preferred adhesive polymers include styrene-butadiene latex, acrylate latices, such as ethylacrylate-hydroxyethylmethacrylate, poly (ethylene-vinylacetate), polyvinylesters, copolyesters, and polyurethanes.

The dry coating weight of this undercoat layer when present is preferably comprised between 0.5 and 10 g/m$^2$.

The ink receiving layer and the optional top- and undercoat layers may further contain well-known conventional ingredients, such as surfactants serving as coating aids, hardening agents plasticizers, whitening agents and matting agents.

Surfactants may be incorporated in the ink-receiving layer of the present invention. They can be any of the cationic, anionic, amphoteric, and non-ionic ones as described in JP-A 62-280068 (1987). Examples of the surfactants are N-alkylamino acid salts, alkylether carboxylic acid salts, acylated peptides, alkylsulfonic acid salts, alkylbenzene and alkylnaphthalene sulfonic acid salts, sulfosuccinic acid salts, α-olefin sulfonic acid salts, N-acylsulfonic acid salts, sulfonated oils, alkylsulfonic acid salts, alkylether sulfonic acid salts, alkylallylethersulfonic acid salts, alkylamidesulfonic acid salts, alkylphosphoric acid salts, alkyletherphosphoric acid salts, alkylallyletherphosphoric acid salts, alkyl and alkylallylpolyoxyethylene ethers, alkylallylformaldehyde condensed acid salts, alkylallylethersulfonic acid salts, alkylamidesulfonic acid salts, alkylphosphoric acid salts, alkyletherphosphoric acid salts, alkylallyletherphosphoric acid salts, alkyl and alkylallylpolyoxyethylene ethers, alkylallylformaldehyde condensed polyoxyethylene ethers, blocked polymers having polyoxypropylene, polyoxyethylene polyoxypropylalkylethers, polyoxyethyleneether of glycolesters, polyoxyethyleneether of sorbitanesters, polyoxyethyleneether of sorbitolesters, polyethyleneglycol aliphatic acid esters, glycerol esters, sorbitane esters, propyleneglycol esters, sugaresters, fluoro $C_2$–$C_{10}$ alkylcarboxylic acids, disodium N-perfluorooctanesulfonyl glutamate, sodium 3-(fluoro-$C_6$–$C_{11}$alkyloxy)-1-$C_3$–$C_4$ alkyl sulfonates, sodium 3-(ω-fluoro-$C_6$–$C_8$ alkanoyl-N-ethylamino)-1-propane sulfonates, N-[3-(perfluorooctanesulfonamide)-propyl]-N,N-dimethyl-N-carboxymethylene ammonium betaine, fluoro-$C_{11}$–$C_{20}$ alkylcarboxylic acids, perfluoro $C_7$–$C_{13}$ alkyl carboxylic acids, perfluorooctane sulfonic acid diethanolamide, Li, K and Na perfluoro $C_4$–$C_{12}$ alkyl sulfonates, N-propyl-N-(2-hydroxyethyl)perfluorooctane sulfonamide, perfluoro $C_6$–$C_{10}$ alkylsulfonamide propyl sulfonyl glycinates, bis-(N-perfluorooctylsulfonyl-N-ethanolaminoethyl) phosphonate, mono-perfluoro $C_6$–$C_{16}$ alkyl-ethyl phosphonates, and perfluoroalkylbetaine.

Useful cationic surfactants include N-alkyl dimethyl ammonium chloride, palmityl trimethyl ammonium chloride, dodecyldimethylamine, tetradecyldimethylamine, ethoxylated alkyl guanidine-amine complex, oleamine hydroxypropyl bistrimonium chloride, oleyl imidazoline, stearyl imidazoline, cocamine acetate, palmitamine, dihydroxyethylcocamine, cocotrimonium chloride, alkyl polyglycolether ammonium sulphate, ethoxylated oleamine, lauryl pyridinium chloride, N-oleyl-1,3-diaminopropane, stearamidopropyl dimethylamine lactate, coconut fatty amide, oleyl hydroxyethyl imidazoline, isostearyl ethylimidonium ethosulphate, lauramidopropyl PEG-dimoniumchloride phosphate, palmityl trimethylammonium chloride, and cetyltrimethylammonium bromide.

Especially useful are the fluorocarbon surfactants as described in e.g. U.S. Pat. No. 4,781,985, having a structure of: $F(CF_2)_{4-9}CH_2CH_2SCH_2CH_2N^+R_3X^-$ wherein R is an hydrogen or an alkyl group; and in U.S. Pat. No. 5,084,340, having a structure of: $CF_3(CF_2)_mCH_2CH_2O(CH_2CH_2O)_nR$ wherein m=2 to 10; n=1 to 18; R is hydrogen or an alkyl group of 1 to 10 carbon atoms. These surfactants are commercially available from DuPont and 3M. The concentration of the surfactant component in the ink-receiving layer is typically in the range of 0.1 to 2%, preferably in the range of 0.4 to 1.5% and is most preferably 0.75% by weight based on the total dry weight of the layer.

The ink-receiving layer according to this invention may be crosslinked to provide such desired features as waterfastness and non-blocking characteristics. The crosslinking is also useful in providing abrasion resistance and resistance to the formation of fingerprints on the element as a result of handling. There are a vast number of known crosslinking agents—also known as hardening agents—that will function to crosslink film forming materials. Hardening agents can be used individually or in combination and in free or in blocked form. A great many hardeners, useful for the present invention, are known, including formaldehyde and free dialdehydes, such as succinaldehyde and glutaraldehyde, blocked dialdehydes, active esters, sulfonate esters, active halogen compounds, isocyanate or blocked isocyanates, polyfunctional isocyanates, melamine derivatives, s-triazines and diazines, epoxides, active olefins having two or more active bonds, carbodiimides, isoxazolium salts subsituted in the 3-position, esters of 2-alkoxy-N-carboxydihydroquinoline, N-carbamoylpyridinium salts, hardeners of mixed function, such as halogen-substituted aldehyde acids (e.g. mucochloric and mucobromic acids), onium substituted acroleins and vinyl sulfones and polymeric hardeners, such as dialdehyde starches and copoly (acroleinmethacrylic acid), and oxazoline functional polymers, e.g. EPOCROS WS-500, and EPOCROS K-1000 series.

When the element is intended for viewing in reflection, the ink-receiving layer of the invention may contain a whitening agent. $TiO_2$ (rutile or anatase) is preferably used as whitening agent.

The ink-receiving layer of the present invention may also comprise a plasticizer such as ethylene glycol, diethylene glycol, propylene glycol, polyethylene glycol, glycerol monomethylether, glycerol monochlorohydrin, ethylene carbonate, propylene carbonate, tetrachlorophthalic anhydride, tetrabromophthalicanhydride, urea phosphate, triphenylphosphate, glycerolmonostearate, propylene glycol monostearate, tetramethylene sulfone, n-methyl-2-pyrrolidone, n-vinyl-2-pyrrolidone.

The ink receiving layer and the optional supplementary layers can be coated onto the support by any conventional coating technique, such as dip coating, knife coating, extrusion coating, spin coating, slide hopper coating and curtain coating.

The support for use in the present invention can be chosen from the paper type and polymeric type support well-known from photographic technology. Paper types include plain paper, cast coated paper, polyethylene coated paper and polypropylene coated paper. Polymeric supports include cellulose acetate propionate or cellulose acetate butyrate, polyesters such as polyethylene terephthalate (PET) and polyethylene naphthalate, polyamides, polycarbonates, polyimides, polyolefins, poly(vinylacetals), polyethers and polysulfonamides. Other examples of useful high-quality polymeric supports for the present invention include opaque white polyesters and extrusion blends of polyethylene terephthalate and polypropylene. Polyester film supports, and especially polyethylene terephthalate, are preferred because of their excellent properties of dimensional stability.

Typical supports for outdoor use include PET, wet strength paper, PVC, PVC with an adhesive backing, the polyethylene paper TYVEK, trade name of Du Pont Co., the porous polyethylene paper TESLIN, trade name of International Paper CO., canvas, polypropylene, and polycarbonate.

The present invention will now be illustrated by the following examples without however being limited thereto.

EXAMPLES

Preparation of Coating Solutions of the Ink Receiving Layer

A 1 litre dispersion was prepared containing 220 g of a commercially available silica (average particle size 6.5 μm), 330 g of a polyvinyl alcohol type (POVAL R3109 of Kuraray Co.), and 113 g of CAT FLOC 71259 (formerly Cat Floc T2), a 40% poly(diallyldimethylammonium chloride) aqueous solution, trade name of Nalco Italiana S.r.l. To 843 ml of this dispersion different copolymer latices were added thus constituting different samples according to table 1 hereinafter.

This solution was coated on one side of a subbed PET-film (100 μm) with a wet thickness of 120 μm, and dried at temperatures between 50 and 70° C.

TABLE 1

Characterization of different copolymers (monomer composition) in the ink receiving layer.

| Sample No. | Monomer comp. | Trade name. | Solid % |
|---|---|---|---|
| 1 comp. | Ethylene-vinylacetate | Airflex EP1(1) | 50% |
| 2 comp. | " | Airflex EP17(2) | 60% |
| 3 comp. | " | Vinavil EVA202(3) | 55% |
| 4 inv. | Ethylene-vinylacetate-vinylversatate | Polysol EVA P550(4) | 55% |
| 5 inv. | Vinyl acetate - vinyl versatate 11 | Experimental dispersion(5) | 53.3% |
| 6 inv. | Ethylene - vinyl acetate - vinyl versatate 10 | Mowilith LDM 1355(6) | 55% |
| 7 inv. | Vinyl acetate - vinyl versatate - acrylate | Enorex 50 AVV(7) | 50% |

(1)trade mark of Air Products Co.
(2)trade mark of Air Products Co.
(3)trade mark of Vinavil/ravemul Co.
(4)trade mark of Showa High polymer Co.
(5)experimental dispersion prepared using VeoVa 11, trade mark of Shell Chemicals Co.
(6)trade mark of Clariant Co.
(7)trade mark of Collano Co.

Evaluation of the Coated Samples.

The obtained media samples were printed with an ENCAD PRO42 printer, trade mark of Encad Co., using pigments inks (GO, trade mark of Encad Co.), or with a Agfajet Sherpa 43 printer, trade name of Agfa-Gevaert N.V., using also pigment inks.

After 1 day the ink jet prints were put in water for 10 minutes after which they were rubbed with a wet finger. The images were visually evaluated on smearing out defects. A quantitative evaluation was established using three arbitrary classifications: A=bad, B=better than A but still visually damaged, C=no smearing out defects. The results are summarized in following table 2. The polymer No. corresponds to the sample No. of table 1.

TABLE 2

| Polymer No. | ml added to 1 l. of the coating solution | Water fastness with GO inks on Encad | Water fastness with pigment inks on Sherpa |
|---|---|---|---|
| 1 comp. | 110 | A | A |
| 1 comp. | 100 | A | A |
| 1 comp. | 91.6 | A | A |
| 2 comp. | 91 | A | A |
| 3 comp. | 99.5 | B | B |
| 3 comp. | 90.4 | B | B |
| 3 comp. | 89.2 | B | B |
| 4 inv. | 110 | C | C |
| 4 inv. | 100 | C | C |
| 4 inv. | 91.6 | C | C |
| 5 inv. | 93.5 | C | C |
| 6 inv. | 90.9 | C | C |
| 7 inv. | 100 | C | C |

It is clear from the table that the incorporation of the copolymer latex containing the repeating unit derived from the vinyl versatate monomer gives a perfect water fastness to the recording medium when printed with pigment inks.

What is claimed is:

1. An ink jet recording element comprising a support and a receiving layer comprising a pigment and a film-forming polymer latex, characterized in that said polymer latex is a copolymer containing repeating units derived from the following monomer (II) below:

(II)

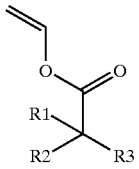

wherein, R3 is $CH_3$, and wherein R1 and R2 taken together are $C_6H_{14}$.

2. An ink jet recording element comprising a support and a receiving layer comprising a pigment and a film-forming polymer latex, characterized in that said polymer latex is a copolymer containing repeating units derived from the following monomer (II) below:

(II)

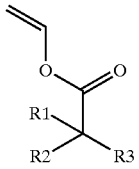

wherein R3 is $CH_3$, and wherein R1 and R2 taken together are C7H16.

3. An ink jet recording element comprising a support and a receiving layer comprising a pigment and a film-forming polymer latex, characterized in that said polymer latex is a copolymer containing repeating units derived from the following monomer (II) below:

(II)

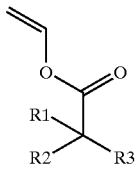

wherein R3 is $CH_3$, and wherein R1 and R2 taken together are $C_8H_{18}$.

4. An ink jet recording element comprising a support and a receiving layer comprising a pigment and a film-forming polymer latex, characterized in that said polymer latex is a copolymer containing repeating units derived from the following monomer (II) below:

(II)

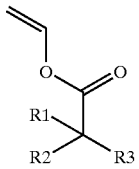

wherein said overall monomer structure (II) is tert-decanoic acid, vinyl ester.

5. An ink jet recording element comprising a support and a receiving layer comprising a pigment and a film-forming polymer latex, characterized in that said polymer latex is a copolymer containing repeating units derived from the following monomer (II) below:

(II)

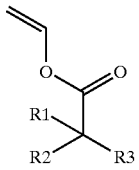

wherein said overall structure (II) is tert-undecanoic acid, ethenyl ester.

* * * * *